US010914053B2

(12) United States Patent
Kai et al.

(10) Patent No.: US 10,914,053 B2
(45) Date of Patent: Feb. 9, 2021

(54) WORK MACHINE

(71) Applicant: Hitachi Construction Machinery Co., Ltd., Tokyo (JP)

(72) Inventors: Takamasa Kai, Tokyo (JP); Teppei Saitou, Tsuchiura (JP); Kenji Hiraku, Tsuchiura (JP); Juri Shimizu, Tokyo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/646,777

(22) PCT Filed: Nov. 16, 2018

(86) PCT No.: PCT/JP2018/042514
§ 371 (c)(1),
(2) Date: Mar. 12, 2020

(87) PCT Pub. No.: WO2019/130898
PCT Pub. Date: Jul. 4, 2019

(65) Prior Publication Data

US 2020/0291612 A1 Sep. 17, 2020

(30) Foreign Application Priority Data

Dec. 28, 2017 (JP) ..... 2017-253186

(51) Int. Cl.
*E02F 9/22* (2006.01)

(52) U.S. Cl.
CPC ..... *E02F 9/2296* (2013.01); *E02F 9/2292* (2013.01); *E02F 9/2235* (2013.01);
(Continued)

(58) Field of Classification Search
CPC ..... F15B 2211/8609; F15B 2211/6346; F15B 11/02; F15B 2211/6654; F15B 11/08; E02F 9/123; E02F 9/22
See application file for complete search history.

(56) References Cited

U.S. PATENT DOCUMENTS 9,879,403 B2 * 1/2018 White ..... F15B 11/08
2014/0331664 A1 * 11/2014 Kamimura ..... E02F 9/123 60/464

(Continued)

FOREIGN PATENT DOCUMENTS

JP 2014-5679 A 1/2014
JP 2015-74531 A 4/2015

(Continued)

OTHER PUBLICATIONS

International Preliminary Report on Patentability (PCT/IB/338 & PCT/IB/373) issued in PCT Application No. PCT/JP2018/042514 dated Jul. 9, 2020, including English translation of document C2 (Japanese-language Written Opinion (PCT/ISA/237) previously filed on Mar. 12, 2020) (nine (9) pages).

(Continued)

*Primary Examiner* — Abiy Teka
(74) *Attorney, Agent, or Firm* — Crowell & Moring LLP

(57) ABSTRACT

Provided is a work machine which makes it possible, in a hydraulic closed-circuit system, to prevent occurrence of cavitation when reverse lever operation which is an instruction for a swing in a direction opposite to a swing direction is performed during swing deceleration. A controller is configured to perform control such that a rate of a flow supplied from a bidirectionally tiltable hydraulic pump to a swing motor becomes lower than a pump flow rate according to an operation amount of the swing operation lever when a swing direction corresponding to a swing velocity (Continued)

sensed at a velocity sensor is different from a swing direction corresponding to operation of a swing operation lever.

4 Claims, 13 Drawing Sheets

(52) U.S. Cl.
CPC ..... *F15B 2211/20546* (2013.01); *F15B 2211/20576* (2013.01); *F15B 2211/6346* (2013.01); *F15B 2211/6654* (2013.01)

(56) References Cited

U.S. PATENT DOCUMENTS

| | | | | |
|---|---|---|---|---|
| 2015/0184362 | A1* | 7/2015 | Komiyama ..... | E02F 9/2267 414/744.2 |
| 2017/0016208 | A1* | 1/2017 | Saitoh ..... | E02F 9/2239 |

FOREIGN PATENT DOCUMENTS

| | | | |
|---|---|---|---|
| JP | 2015-75171 | A | 4/2015 |
| JP | 2017-106251 | A | 6/2017 |
| WO | WO 2015/198644 | | 12/2015 |

OTHER PUBLICATIONS

International Search Report (PCT/ISA/210) issued in PCT Application No. PCT/JP2018/042514 dated Jan. 8, 2019 with English translation (four (4) pages).

Japanese-language Written Opinion (PCT/ISA/237) issued in PCT Application No. PCT/JP2018/042514 dated Jan. 8, 2019 (five (5) pages).

* cited by examiner

<CONVENTIONAL TECHNIQUE>

WORK MACHINE

TECHNICAL FIELD

The present invention relates to a work machine such as a hydraulic excavator.

BACKGROUND ART

In the field of work machines such as hydraulic excavators, work machines are in most cases equipped with a hydraulic circuit (open circuit) that supplies a hydraulic operating fluid from hydraulic pumps to hydraulic actuators and makes a return fluid from the hydraulic actuators flow back to a hydraulic operating fluid tank. However, in recent years, in order to decrease the fuel consumption amount, development is underway for a hydraulic circuit (closed circuit) with fewer restrictor elements in which hydraulic actuators and hydraulic pumps are connected annularly such that a return fluid from the hydraulic actuators flows back directly to the hydraulic pumps. For example, Patent Document 1 discloses a work machine equipped with such a closed circuit.

Patent Document 1 describes a work machine including a first hydraulic circuit that connects a hydraulic motor (swing motor) as a first actuator for swing-driving a swing structure and a first pump motor (bidirectionally tiltable pump) to form a closed circuit in a flow line through which a hydraulic operating fluid flows and that is provided with a first opening/closing device that opens and closes a flow line between the hydraulic motor and the first pump motor, the first pump motor being able to cause the hydraulic operating fluid to flow in thereto and out therefrom in both directions and having a displacement volume that can be controlled, a second hydraulic circuit that connects a second hydraulic actuator different from the hydraulic motor and a second pump motor (bidirectionally tiltable pump) to form a closed circuit in a flow line through which a hydraulic operating fluid flows and that is provided with the second opening/closing device that opens and closes a flow line between the second hydraulic actuator and the second pump motor, the second pump motor being able to cause the hydraulic operating fluid to flow in thereto and out therefrom in both directions and having a displacement volume that can be controlled, a merging flow line connected between the first hydraulic circuit and the second hydraulic circuit, a first-merging-flow-line opening/closing device that opens and closes the first merging flow line, and a controller that controls the first and second pump motors, the first and second opening/closing devices, and the first-merging-flow-line opening/closing device. In the work machine, the controller includes a swing-deceleration sensing section that senses a state in which the swing structure is being decelerated, a pump operation determining section that determines an operation state of the second pump motor, and a control section that controls the displacement volumes of the first and second pump motors and opening and closing of the first and second opening/closing devices and the first-merging-flow-line opening/closing device. When the swing-deceleration sensing section senses a state in which the swing structure is being decelerated, the pump operation determining section determines that the second pump motor is not supplying a hydraulic operating fluid to the second hydraulic actuator, and the first pump motor cannot singly regenerate the inertial energy that accompanies a swing, the control section outputs an opening signal for the first opening/closing device, outputs a closing signal for the second opening/closing device, outputs an opening signal for the first-merging-flow-line opening/closing device that makes the second hydraulic closed circuit and the first hydraulic closed circuit merge, and furthermore controls the displacement volume of the first pump motor and the displacement volume of the second pump motor such that suction pressures thereof become higher than delivery pressures thereof to make the first pump motor and the second pump motor function as motors.

According to the work machine described in Patent Document 1, the displacement volumes of the first and second pump motors are increased on a side where the suction pressures of the first and second pump motors become higher than their delivery pressures to make the first and second pump motor function as motors. Energy that is part of the energy of the hydraulic operating fluid discharged from a swing hydraulic motor while the swing structure is being decelerated and that cannot fully be regenerated singly by the first pump motor can thereby be regenerated by the second pump motor.

PRIOR ART DOCUMENT

Patent Document

Patent Document 1: WO2015/198644

SUMMARY OF THE INVENTION

Problem to be Solved by the Invention

However, in the work machine described in Patent Document 1, the suction-side of the swing motor is connected to the suction-side of the bidirectionally tiltable pump when reverse lever operation which is an instruction for a swing in a direction opposite to a swing direction is performed during swing deceleration. Accordingly, there is a fear that the pressure of the suction-side of the bidirectionally tiltable pump becomes a negative pressure and that cavitation occurs.

The present invention is made in view of the problem explained above, and an object thereof is to provide a work machine that makes it possible, in a hydraulic closed-circuit system, to prevent occurrence of cavitation when reverse lever operation which is an instruction for a swing in a direction opposite to a swing direction is performed during swing deceleration.

Means for Solving the Problem

In order to achieve the object explained above, in the present invention, a work machine includes a lower track structure, an upper swing structure swingably attached onto the lower track structure, a swing motor that drives the upper swing structure, a bidirectionally tiltable first hydraulic pump, two flow lines that connect the swing motor and the first hydraulic pump to form a closed circuit, a charge pump, a charge flow line connected to the charge pump, a supplementing valve device that is provided between the two flow lines and the charge flow line and supplements a deficiency in a flow rate of the two flow lines with a flow from the charge flow line, a swing operation lever for giving an instruction on operation of the upper swing structure, a swing-velocity sensor that senses a swing velocity of the upper swing structure, and a controller that controls a tilting angle of the first hydraulic pump according to operation of the swing operation lever. In the work machine, when a swing direction corresponding to a swing velocity sensed at the swing-velocity sensor is different from a swing direction corresponding to operation of the swing operation lever, the controller performs control such that a rate of a flow supplied from the first hydraulic pump to the swing motor becomes lower than a pump flow rate according to an operation amount of the swing operation lever.

According to the present invention configured as described above, when the swing direction corresponding to the swing velocity sensed at the swing-velocity sensor is different from the swing direction corresponding to the operation of the swing operation lever, control is performed such that the delivery flow rate of the first hydraulic pump becomes lower than the delivery flow rate according to the operation amount of the swing operation lever. When reverse lever operation is performed during swing deceleration, the deficiency of the flow rate in the closed circuit is thereby kept at a rate of flow which can be supplied from the charge pump via the supplementing valve device or lower. Accordingly, occurrence of cavitation can be prevented.

Advantages of the Invention

According to the present invention, in a work machine equipped with the hydraulic closed-circuit system, occurrence of cavitation can be prevented when reverse lever operation which is an instruction for a swing in a direction opposite to a swing direction is performed during swing deceleration.

MODES FOR CARRYING OUT THE INVENTION

Figure 1:
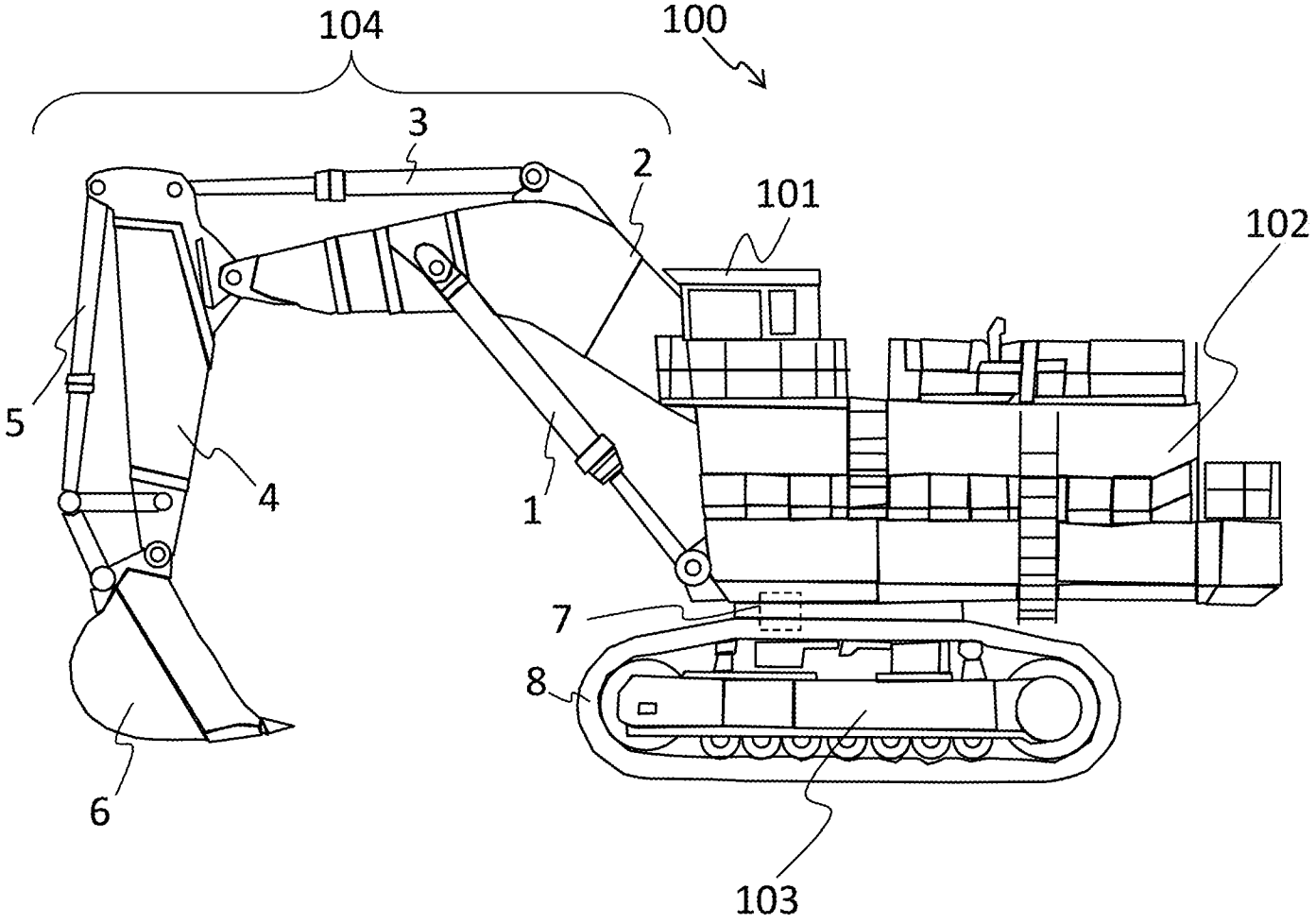
FIG. 1 is a side view illustrating a hydraulic excavator as one example of a work machine according to the present embodiment.

Hereinafter, embodiments of the present invention are explained with reference to the drawings. Note that equivalent members in the drawings are given the same reference characters, and overlapping explanations are omitted as appropriate.

FIG. 1 is a side view illustrating a hydraulic excavator as one example of a work machine according to the present embodiment.

In FIG. 1, a hydraulic excavator 100 includes a lower track structure 103 including crawler-type travel devices 8 on both sides in the left and right directions, and an upper swing structure 102 swingably attached onto the lower track structure 103. A cab 101 which an operator gets in is provided on the upper swing structure 102. The lower track structure 103 and the upper swing structure 102 can be swung via a swing motor 7 which is a hydraulic motor.

A base end section of a front work implement 104 which is a work device for performing excavation work and the like, for example, is pivotably attached to the front side of the upper swing structure 102. Here, the front side refers to the side which the operator who gets in the cab 101 faces (the left side in FIG. 1).

The front work implement 104 includes a boom 2 whose base end section is coupled to the front side of the upper swing structure 102 such that the boom 2 can pivot upward and downward. The boom 2 is operated via a boom cylinder 1 which is a single rod type hydraulic cylinder. A base end section of an arm 4 is coupled to a tip end section of the boom 2 such that the arm 4 can pivot upward and downward and forward and backward. The arm 4 is operated via an arm cylinder 3 which is a single rod type hydraulic cylinder. A base end section of a bucket 6 is coupled to a tip end section of the arm 4 such that the bucket 6 can pivot upward and downward and forward and backward. The bucket 6 is operated via a bucket cylinder 5 which is a single rod type hydraulic cylinder.

In the cab 101, a boom-operation lever 26 (illustrated in FIG. 11), an arm operation lever (not illustrated), a bucket operation lever (not illustrated), and a swing operation lever 17 (illustrated in FIG. 2) for operating the boom 2, the arm 4, the bucket 6, and the upper swing structure 102 are arranged.

First Embodiment

The hydraulic excavator 100 according to a first embodiment of the present invention is explained by using FIG. 2 to FIG. 6.

Figure 2:
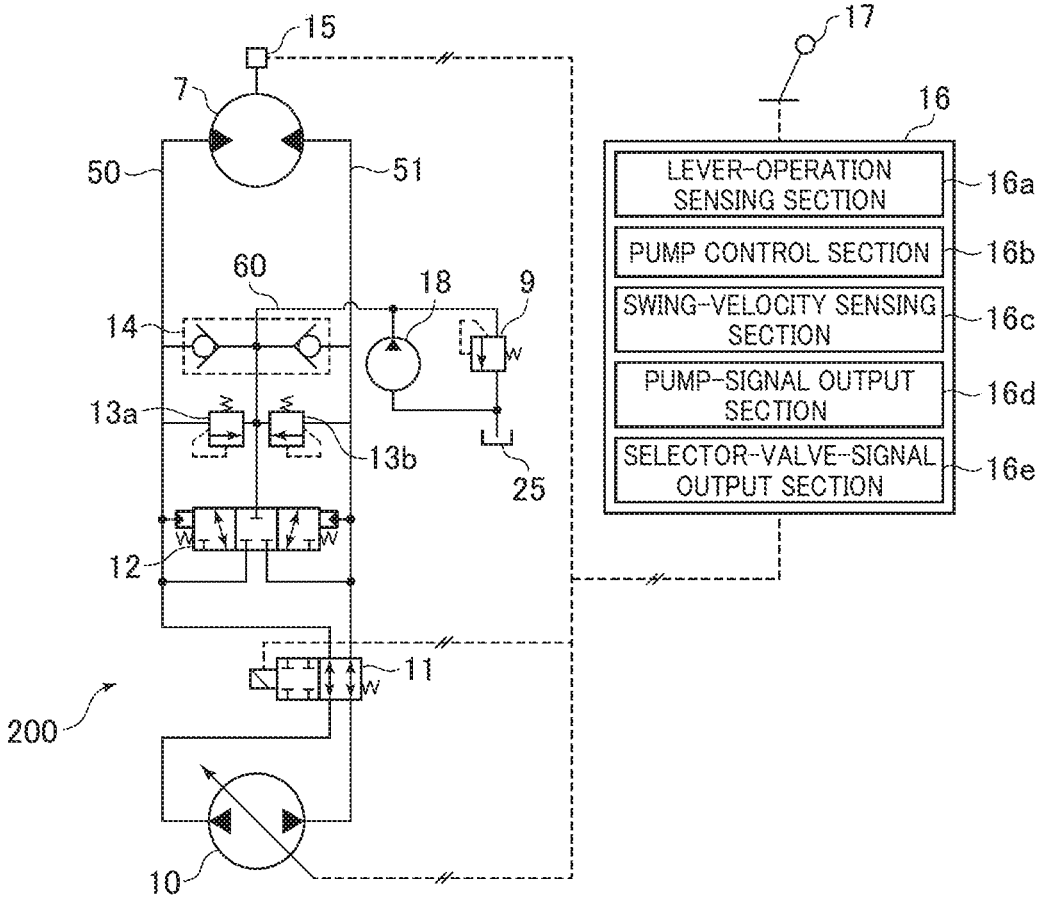
FIG. 2 is a schematic configuration diagram of a hydraulic closed-circuit system mounted on the hydraulic excavator illustrated in FIG. 1.

FIG. 2 is a schematic configuration diagram of a hydraulic closed-circuit system mounted on the hydraulic excavator 100. Note that only sections related to driving of the swing motor 7 are illustrated in FIG. 2 for simplification of explanations, and sections related to driving of the other hydraulic actuators are omitted.

In FIG. 2, a hydraulic closed-circuit system 200 includes a bidirectionally tiltable hydraulic pump (hereinafter, a pump) 10 and a charge pump 18 that are driven by an engine (not illustrated), the swing motor 7, the swing operation lever 17 for giving an instruction on operation of the upper swing structure 102, flow lines 50 and 51 that connect the pump 10 and the swing motor 7 annularly (to form a closed circuit), a selector valve 11 that establishes or interrupts communication through the flow lines 50 and 51, a charge relief valve 9, a flushing valve 12, relief valves 13*a* and 13*b*, a makeup valve 14, a velocity sensor 15 as a swing-velocity sensor that senses the rotation velocity of the swing motor 7, and a controller 16 as a controller.

The delivery port of the charge pump 18 is connected to a charge flow line 60. The charge flow line 60 is connected to a hydraulic operating fluid tank 25 via the charge relief valve 9. The charge relief valve 9 discharges a surplus fluid in the charge flow line 60 to the hydraulic operating fluid tank 25 when the pressure in the charge flow line 60 becomes a preset pressure, and keeps the pressure in the charge flow line 60 at a certain pressure or lower.

The flow lines 50 and 51 are connected to the charge flow line 60 via the flushing valve 12, the relief valves 13*a* and 13*b*, and the makeup valve 14. The flushing valve 12 connects the lower-pressure sides of the flow lines 50 and 51 to the charge flow line 60. As a result, surplus flow rate of the flow lines 50 and 51 is discharged to the charge flow line 60 or a deficiency of the flow rate of the flow lines 50 and 51 is supplemented with a flow from the charge flow line 60. The relief valves 13*a* and 13*b* discharge a surplus fluid in the flow lines 50 and 51 to the charge flow line 60 when the pressure in the flow lines 50 and 51 becomes a preset pressure, and keeps the pressure in the flow lines 50 and 51 at a certain pressure or lower. The makeup valve 14 supplies a hydraulic operating fluid in the charge flow line 60 to the flow lines 50 and 51 such that the pressure in the flow lies 50 and 51 does not becomes a negative pressure.

The controller 16 controls the pump 10 and the selector valve 11 on the basis of an operation amount of the swing operation lever 17 and information from various types of sensors including the velocity sensor 15.

Figure 3:
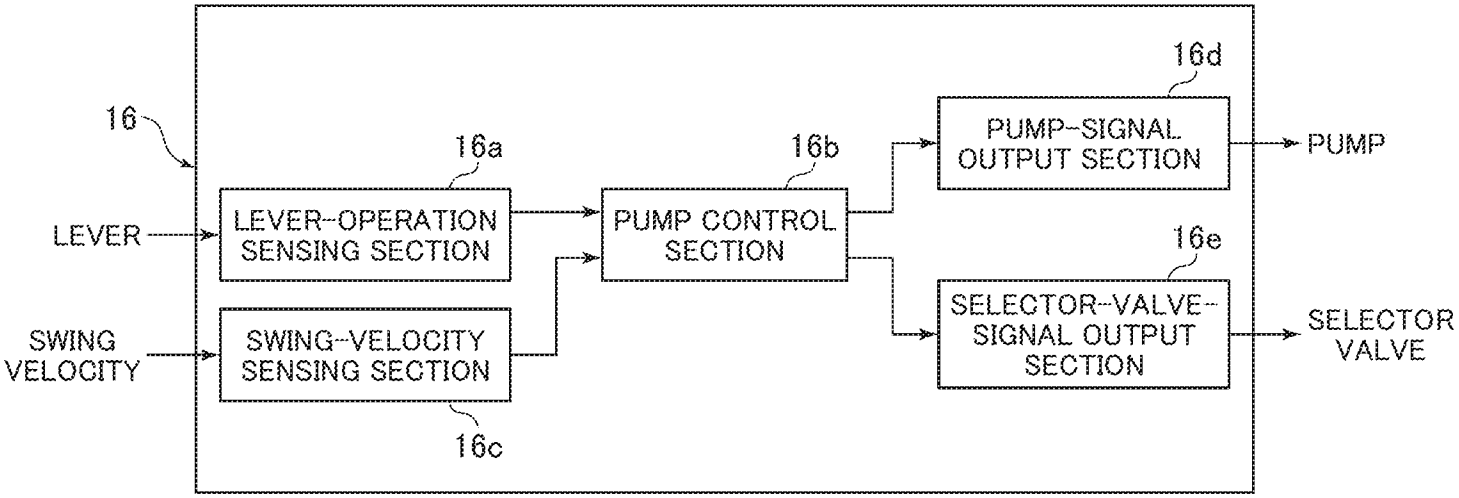
FIG. 3 is a functional block diagram of a controller illustrated in FIG. 2.

FIG. 3 is a functional block diagram of the controller 16.

In FIG. 3, the controller 16 includes a lever-operation sensing section 16*a*, a pump control section 16*b*, a swing-velocity sensing section 16*c*, a pump-signal output section 16*d*, and a selector-valve-signal output section 16*e*.

The lever-operation sensing section 16*a* computes a lever operation amount on the basis of an operation signal from the swig operation lever 17, and outputs the computed lever operation amount to the pump control section 16*b*.

The swing-velocity sensing section 16*c* calculates a swing velocity of the upper swing structure 102 on the basis of a sensing signal of the velocity sensor 15, and outputs the calculated swing velocity to the pump control section 16*b*.

The pump control section 16*b* generates a tilting-angle command for the pump 10 and an opening/closing command for the selector valve 11 on the basis of the lever operation amount from the lever-operation sensing section 16*a* and the swing velocity from the swing-velocity sensing section 16*c*, and outputs the tilting-angle command and the opening/closing command to the pump-signal output section 16*d* and the selector-valve-signal output section 16*e*, respectively.

The pump-signal output section 16*d* controls the pump 10 according to the tilting-angle command from the pump control section 16*b*.

The selector-valve-signal output section 16*e* controls the switch 11 according to the opening/closing command from the pump control section 16*b*.

Figure 4:
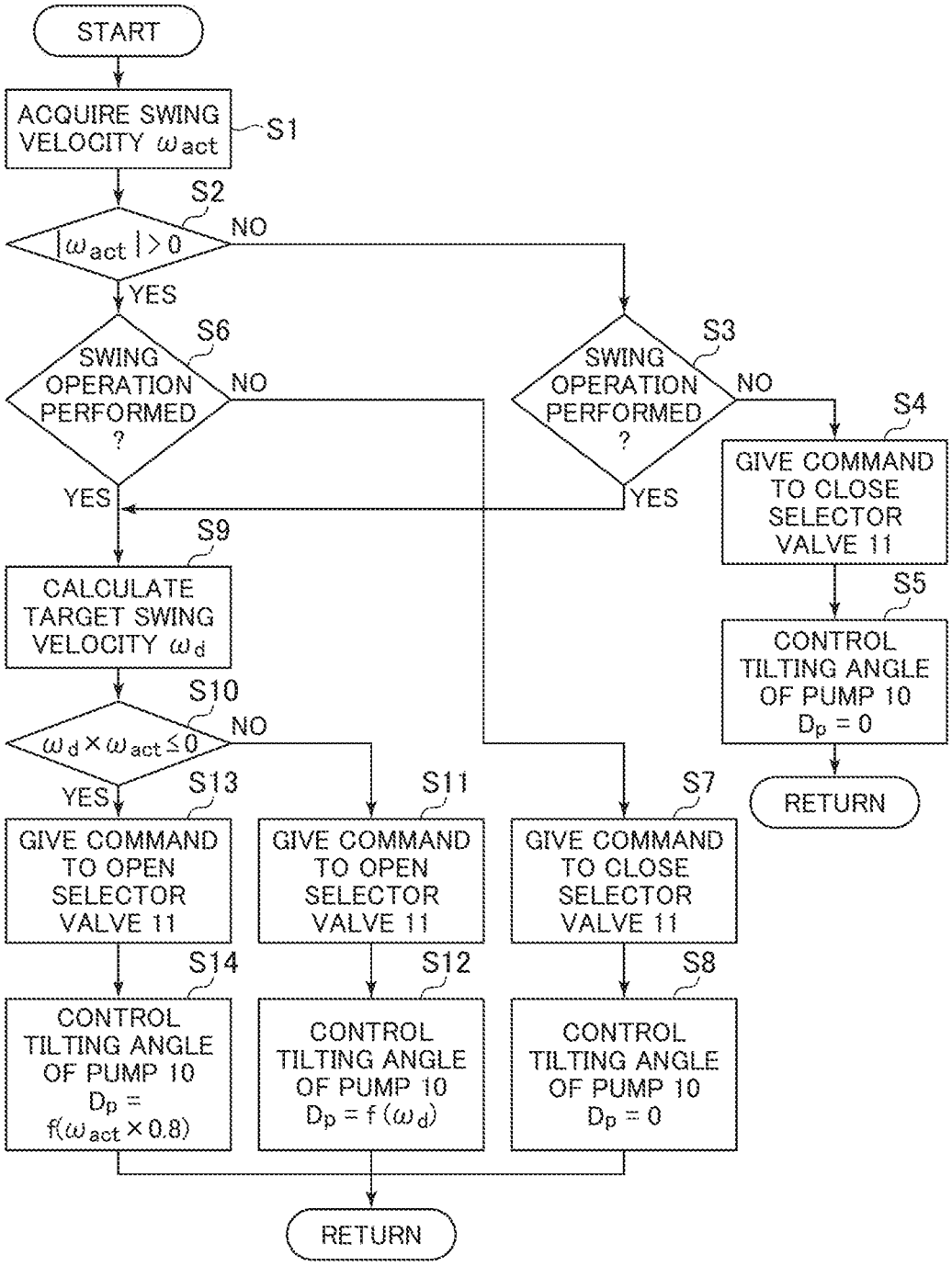
FIG. 4 is a flowchart illustrating a process of a pump control section according to a first embodiment of the present invention.

FIG. 4 is a flowchart illustrating a process of the pump control section 16*b* according to the present embodiment. Hereinafter, steps are explained one by one.

First, in Step S1, a swing velocity ωact is acquired from the swing-velocity sensing section 16*c*. Here, the swing velocity ωact assumes a positive value at the time of a rightward swing and a negative value at the time of a leftward swing.

Subsequent to Step S1, in Step S2, it is determined whether or not the upper swing structure 102 is being swung. Specifically, the determination is made on the basis of whether or not the absolute value of the swing velocity ωact is larger than 0.

When the determination result in Step S2 is No (swing stopped), in Step S3, it is determined whether or not the swing operation lever 17 is operated.

When the determination result in Step S3 is No (no swing operation performed), the selector valve 11 is closed in Step S4, a tilting angle DP of the pump 10 is controlled such that the tilting angle DP becomes 0 in Step S5, and the process returns to Step S1. A hydraulic operating fluid is thereby not supplied from the pump 10 to the swing motor 7, and the swing motor 7 is kept stopped.

When the determination result in Step S2 is Yes (swing being performed), in Step S6, it is determined whether or not the swing operation lever 17 is operated.

When the determination result in Step S6 is No (no swing operation performed), the selector valve 11 is closed in Step S7, the tilting angle DP of the pump 10 is controlled such that the tilting angle DP becomes 0 in Step S8, and the process returns to Step S1. The supply of the hydraulic operating fluid from the pump 10 to the swing motor 7 is thereby stopped, and deceleration of the swing motor 7 is started.

When the determination result in Step S3 is Yes (swing operation performed) or when the determination result in Step S6 is Yes (swing operation performed), in Step S9, a target swing velocity ωd is calculated on the basis of a lever operation amount. Here, similarly to the swing velocity ωact, the target swing velocity ωd assumes a positive value at the time of a rightward swing and a negative value at the time of a leftward swing.

Subsequent to Step S9, in Step S10, it is determined whether or not reverse lever operation which is an instruction for a swing in a direction opposite to a swing direction is being performed. Specifically, the determination is made on the basis of whether or not the product of the target swing velocity ωd by the swing velocity ωact is equal to or smaller than 0. When the product of the target swing velocity ωd by the swing velocity ωact is equal to or smaller than 0, the swing direction corresponding to the swing velocity ωact is different from the swing direction corresponding to the lever operation amount. Accordingly, it is determined that reverse lever operation is being performed (Yes). On the other hand, when the product of the target swing velocity ωd by the swing velocity ωact is larger than 0, the current swing direction is the same as the swing direction intended by an operator. Accordingly, it is determined that forward lever operation is being performed (No).

When the determination result in Step S10 is No (forward lever operation performed), the selector valve 11 is opened in Step S11, the tilting angle DP of the pump 10 is controlled according to the target swing velocity ωd in Step S12, and the process returns to Step S1. The hydraulic operating fluid is thereby supplied from the pump 10 to the swing motor 7, and the swing motor 7 is driven.

When the determination result in Step S10 is Yes (reverse lever operation performed), the selector valve 11 is opened in Step S13, the tilting angle DP of the pump 10 is controlled according to the target swing velocity ωd multiplied by a gain smaller than 1 (0.8 in the present embodiment) in Step S14, and the process returns to Step S1. While reverse lever operation is being performed, the rate of a flow to be taken in by the pump 10 from the flow line 50 or 51 on the suction-side of the swing motor 7 can thereby be kept lower than that in a case where the rate is controlled according to the target swing velocity ωd.

Figure 5:
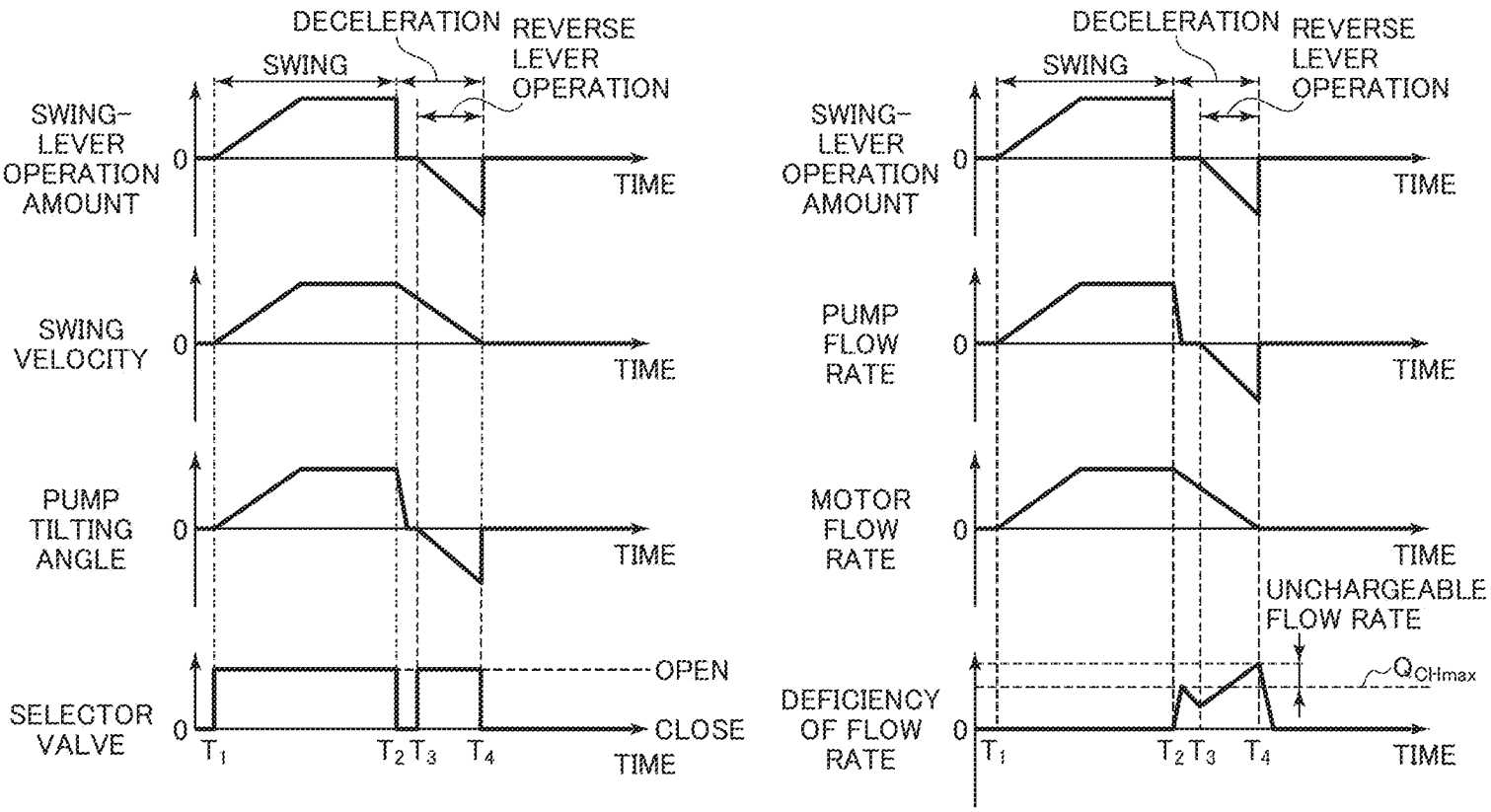
FIG. 5 is a figure illustrating operation in a hydraulic closed-circuit system to which control according to a conventional technology is applied, when reverse lever operation which is an instruction for a swing in a direction opposite to a swing direction is performed during swing deceleration.

FIG. 5 is a figure illustrating operation in the hydraulic closed-circuit system 200 to which control according to a conventional technology is applied, when reverse lever operation which is an instruction for a swing in a direction opposite to a swing direction is performed during swing deceleration.

First, operation of the swing operation lever 17, and the tilting angle of the pump 10, the swing velocity, and the behavior of the selector valve 11 that accompany the operation are explained by using the graph on the left side in the figure.

When operation of the swing operation lever 17 is performed at Time T1, the tilting angle increases according to the lever operation amount, and the swing velocity increases. At this time, the selector valve 11 is opened to establish a closed-circuit connection between the swing motor 7 and the pump 10.

When the operation of the swing operation lever 17 is ended at Time T2, the pump tilting angle becomes 0, and the swing velocity decreases accompanying the end of the operation. In addition, the selector valve 11 is closed to interrupt the communication through the flow lines 50 and 51 between the pump 10 and the swing motor 7.

At Time T3, reverse lever operation which is an instruction for a swing in a direction opposite to the swing direction is started during the swing deceleration. The tilting angle of the pump 10 increases toward the discharge-side of the swing motor 7 according to the operation amount of the swing operation lever 17. The selector valve 11 is opened according to the operation of the swing operation lever 17, and establishes a closed-circuit connection between the swing motor 7 and the pump 10.

When the operation of the swing operation lever 17 is ended at Time T4, the tilting angle of the pump 10 becomes 0, the swing velocity becomes 0 (the swing motor 7 is stopped), and the selector valve 11 is closed.

Changes in the delivery flow rate of the pump 10 (pump flow rate), the rate of a flow supplied to the swing motor 7 (motor flow rate), and the deficiency of a flow rate in the closed circuit (flow lines 50 and 51) in relation to the series of the lever operation are explained by using the graph on the right side in the figure.

The hydraulic operating fluid is supplied from the pump 10 to the swing motor 7 via the flow line 50 or 51 by performing the operation of the swing operation lever 17 at Time T1. Accordingly, both the pump flow rate and the motor flow rate increase.

When the operation of the swing operation lever 17 is ended at Time T2, the pump flow rate becomes 0, and the hydraulic operating fluid is no longer supplied from the pump 10. The the motor flow rate thus decreases as well. At this time, the communication through the flow lines 50 and 51 having been establishing a closed-circuit connection between the pump 10 and the swing motor 7 is interrupted by the selector valve 11. The pressure in the flow line 50 or 51 on the discharge-side of the swing motor 7 thereby increases, and the hydraulic operating fluid is discharged from the relief valve 13*a* or 13*b* to the charge flow line 60. At this time, the pressure on the discharge-side of the swing motor 7 increases to the pressure set for the relief valve 13*a* or 13*b*, and thus, deceleration of the swing motor 7 is started. On the other hand, the suction flow rate of the swing motor 7 is supplied from the charge pump 18 via the makeup valve 14 or the flushing valve 12 (supplementing valve device).

At Time T3, reverse lever operation which is an instruction for a swing in a direction opposite to the swing direction is started during the swing deceleration. The pump 10 takes in the hydraulic operating fluid from the flow line 50 or 51 on the suction-side of the swing motor 7 according to the reverse lever operation, and delivers the hydraulic operating fluid to the flow line 51 or 50 on the discharge-side of the swing motor 7. At this time, similarly to the suction flow rate of the swing motor 7, the suction flow rate of the pump 10 is supplied from the charge pump 18 via the makeup valve 14 or the flushing valve 12 (supplementing valve device). However, the total flow rate of the suction flow rate of the swing motor 7 and the suction flow rate of the pump 10 temporarily exceeds the flow rate QCHmax that can be supplied by the charge pump 18 (chargeable flow rate), in some cases. As a result, the pressure in the closed circuit (flow lines 50 and 51) assumes a negative pressure, and the risk of occurrence of cavitation arises.

Figure 6:
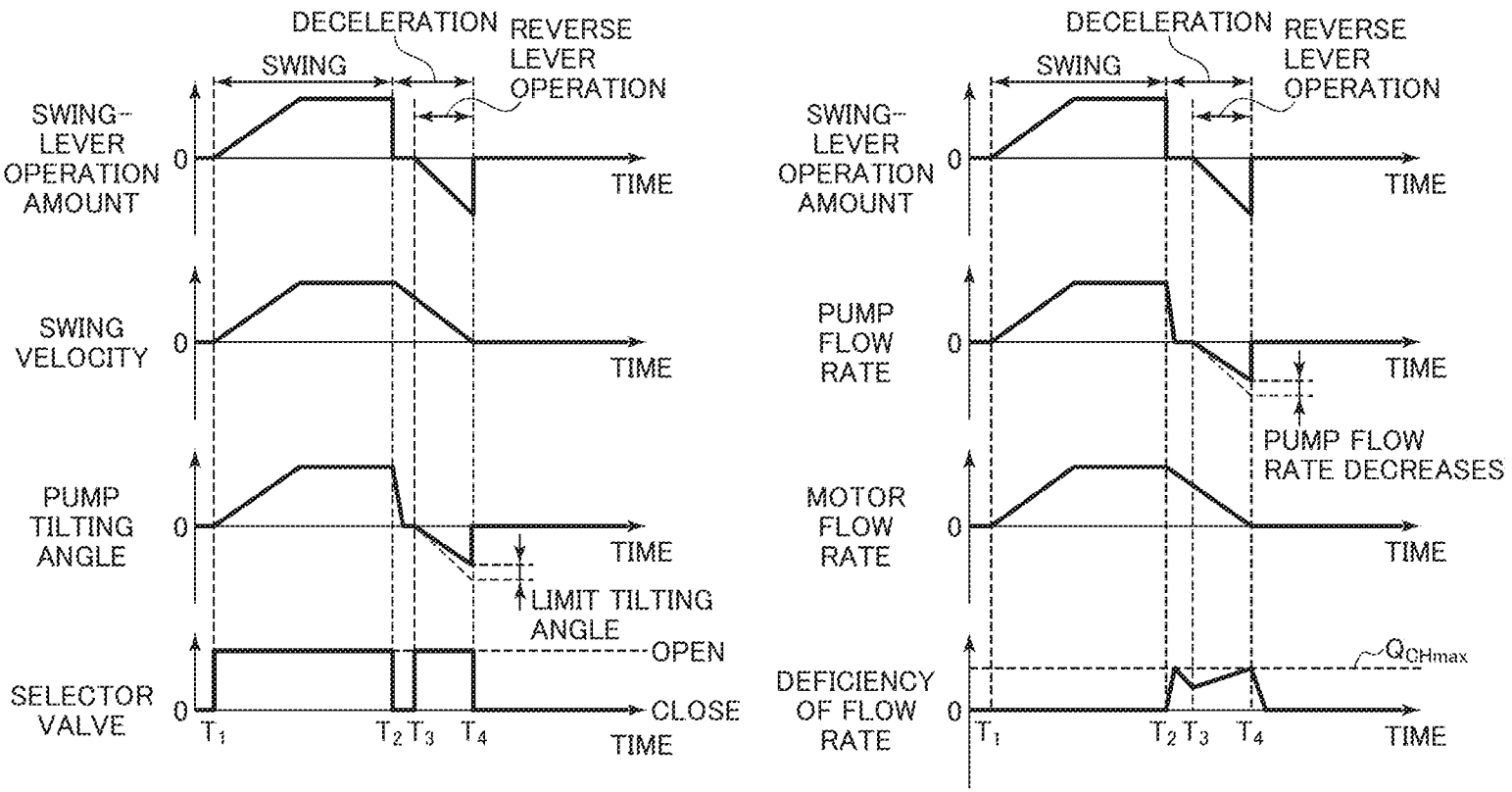
FIG. 6 is a figure illustrating operation in the hydraulic closed-circuit system according to the first embodiment of the present invention when reverse lever operation which is an instruction for a swing in a direction opposite to a swing direction is performed during swing deceleration.

FIG. 6 is a figure illustrating operation in the hydraulic closed-circuit system 200 according to the present embodiment when reverse lever operation is performed. Hereinafter, differences from the conventional technology (illustrated in FIG. 5) are explained.

When reverse lever operation is started at Time T3, the pump 10 delivers the hydraulic operating fluid according to the lever operation amount, and the selector valve 11 is opened to form a flow line. At this time, the pump tilting angle is controlled such that the delivery flow rate of the pump 10 (pump flow rate) becomes lower than the pump flow rate according to the target swing velocity ωd.

According to the thus-configured hydraulic excavator 100 according to the present embodiment, while the reverse lever operation is being performed, the rate of the flow to be taken in by the pump 10 from the flow lines 50 and 51 can be kept lower than the pump flow rate according to the lever operation amount. The deficiency of the flow rate in the closed circuit (flow lines 50 and 51) thereby becomes equal to or lower than the flow rate QCHmax that can be supplied by the charge pump 18 (chargeable flow rate). Accordingly, the pressure in the closed circuit (flow lines 50 and 51) can be prevented from assuming a negative pressure, and the risk of occurrence of cavitation can be kept low.

Second Embodiment

Figure 7:
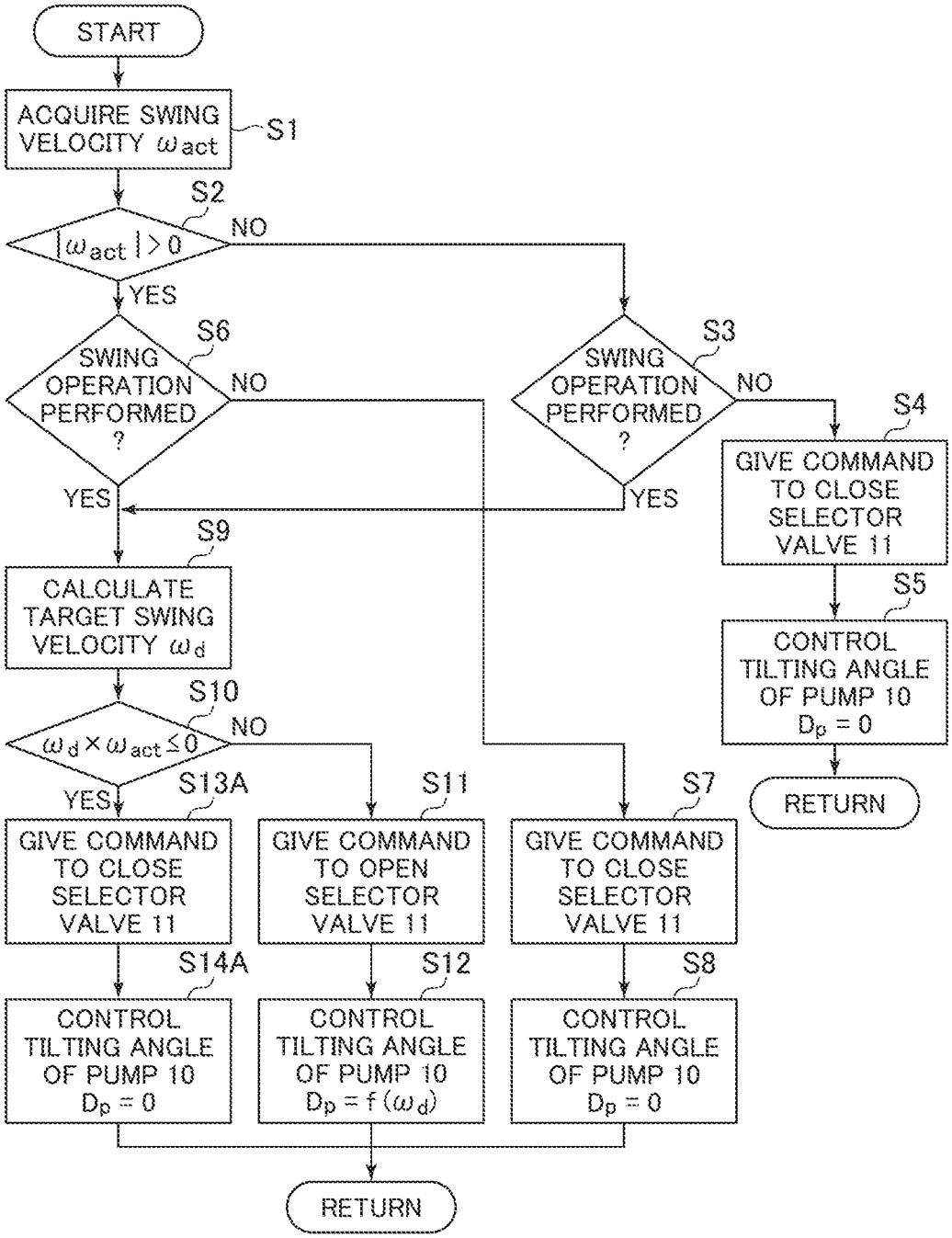
FIG. 7 is a flowchart illustrating a process of the pump control section according to the first embodiment of the present invention.
Figure 8:
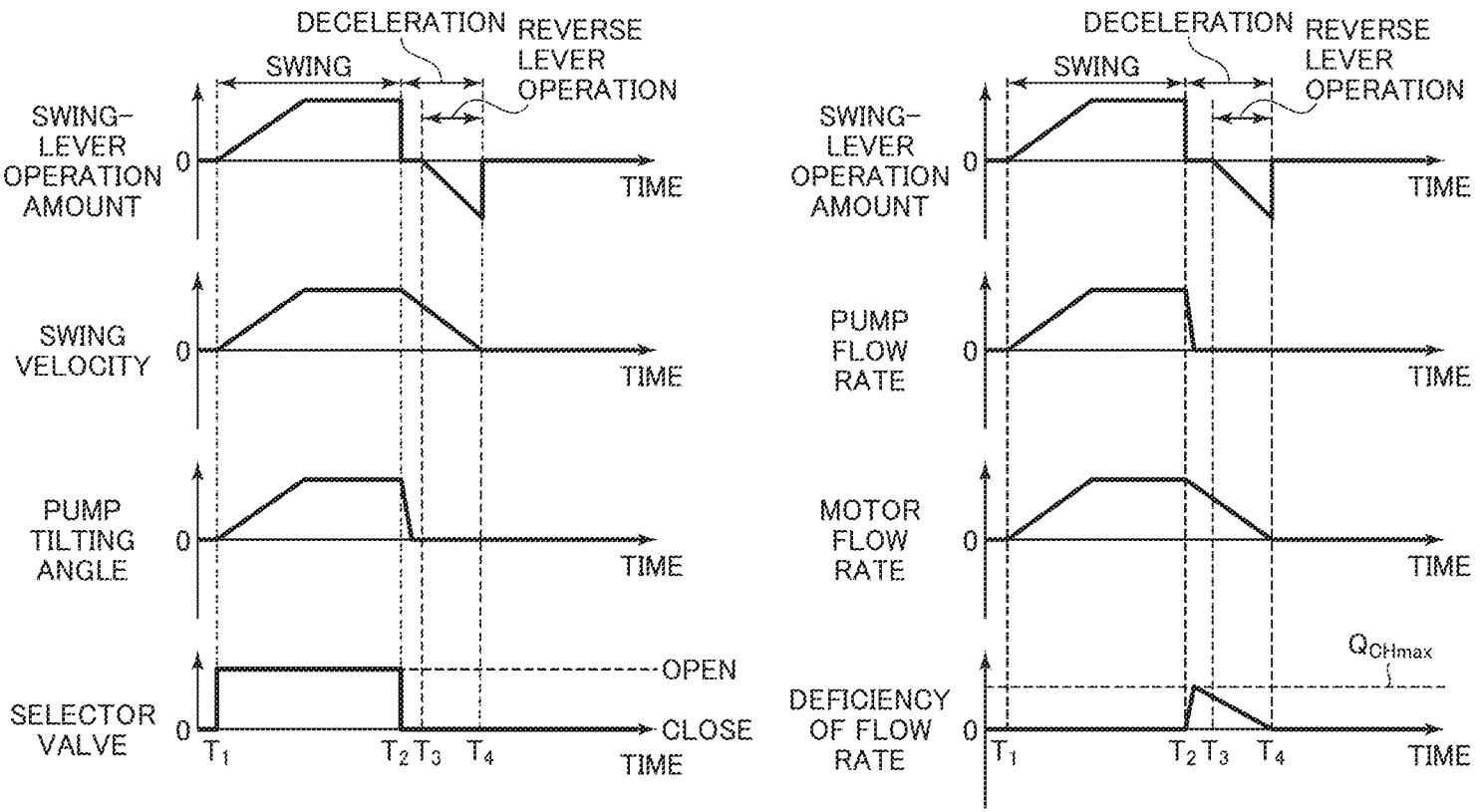
FIG. 8 is a figure illustrating operation in the hydraulic closed-circuit system according to the second embodiment of the present invention when reverse lever operation which is an instruction for a swing in a direction opposite to a swing direction is performed during swing deceleration.

The hydraulic excavator 100 according to a second embodiment of the present invention is explained by using FIG. 7 and FIG. 8.

FIG. 7 is a flowchart illustrating a process of the pump control section 16*b* (illustrated in FIG. 3) according to the present embodiment. Hereinafter, differences from the first embodiment (illustrated in FIG. 4) are mainly explained.

In FIG. 7, when the determination result in Step S10 is Yes (reverse lever operation performed), the selector valve 11 is closed in Step S13A, the tilting angle DP of the pump 10 is controlled such that the tilting angle DP becomes 0 in Step S14A, and the process returns to Step S1. The delivery flow rate of pump 10 (pump flow rate) thereby becomes 0 while the reverse lever operation is being performed.

FIG. 8 is a figure illustrating operation of the hydraulic closed-circuit system 200 when reverse lever operation is performed in the hydraulic excavator 100 according to the present embodiment. Hereinafter, differences from the first embodiment (illustrated in FIG. 6) are explained.

In FIG. 8, while the reverse lever operation is being performed (Time T3 to Time T4), the selector valve 11 is closed, and the pump tilting angle is controlled such that the pump tilting angle becomes 0. The pump flow rate thereby becomes 0. Accordingly, the rate of the flow to be taken in by the pump 10 from the flow line 50 or 51 on the suction-side of the swing motor 7 becomes 0. The deficiency of the flow rate in the closed circuit (flow lines 50 and 51) thereby matches the suction flow rate of the swing motor (motor flow rate), and becomes equal to or lower than the chargeable flow rate QCHmax. Accordingly, the pressure in the closed circuit (flow lines 50 and 51) can be prevented from assuming a negative pressure.

According to the thus-configured hydraulic excavator 100 according to the present embodiment, while reverse lever operation is being performed, the rate of the flow to be taken in by the pump 10 from the flow line 50 or 51 on the suction-side of the swing motor 7 becomes 0. The deficiency of the flow rate in the closed circuit (flow lines 50 and 51) thereby becomes smaller than that in the first embodiment (illustrated in FIG. 4). Accordingly, the risk of occurrence of cavitation can be kept lower than that in the first embodiment.

Third Embodiment

Figure 9:
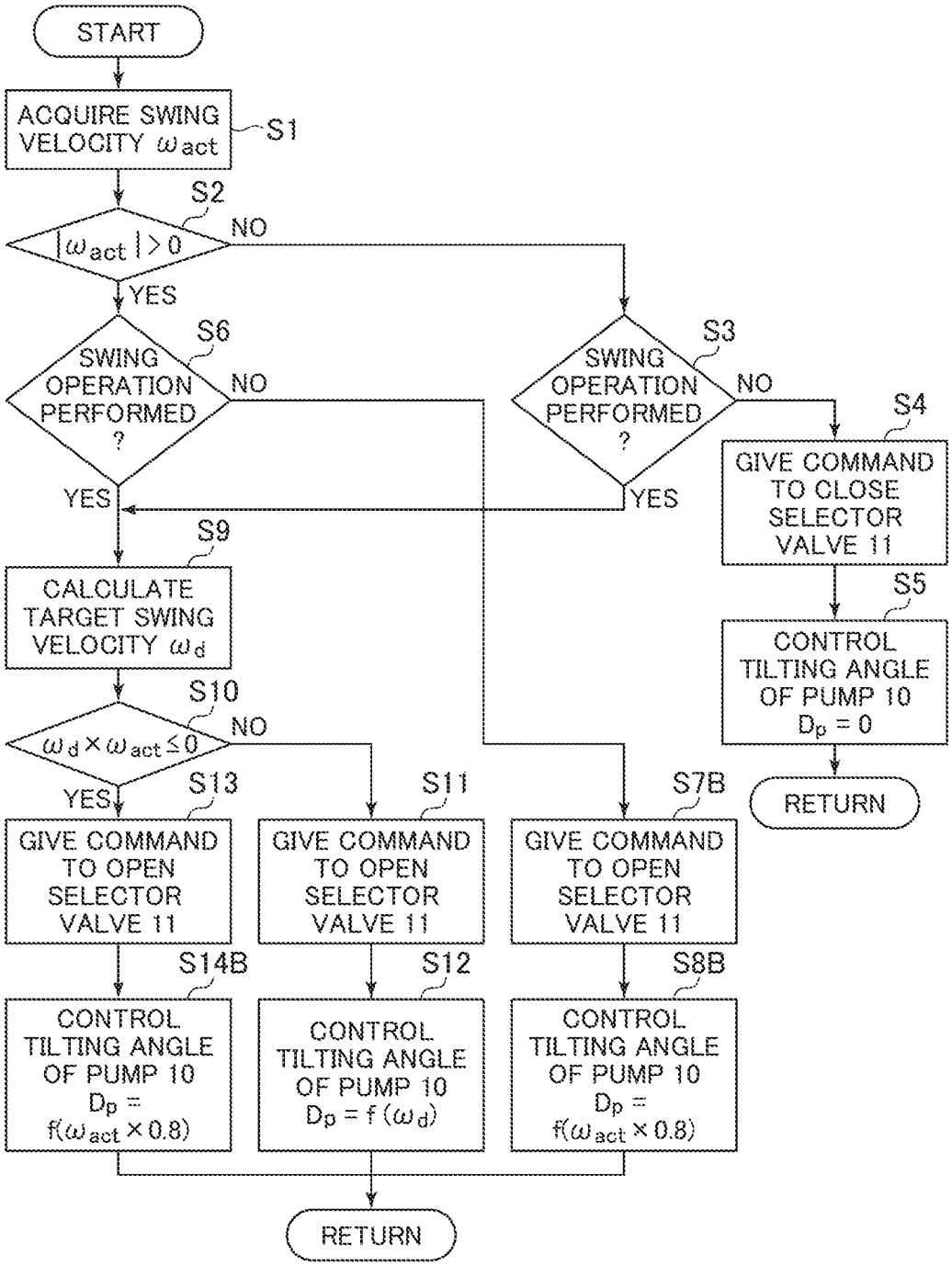
FIG. 9 is a flowchart illustrating a process of the pump control section according to a third embodiment of the present invention.
Figure 10:
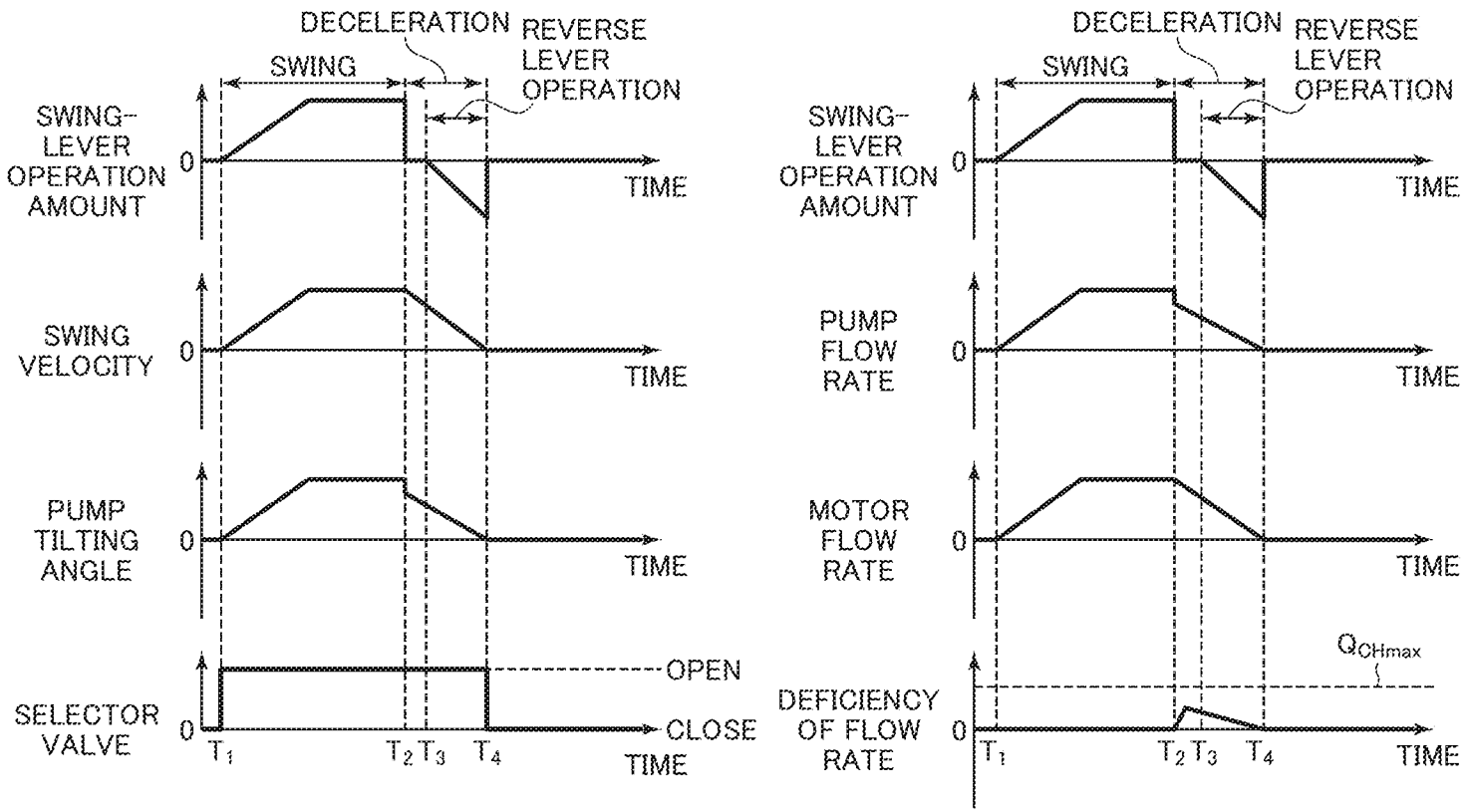
FIG. 10 is a figure illustrating operation in the hydraulic closed-circuit system according to the third embodiment of the present invention when reverse lever operation which is an instruction for a swing in a direction opposite to a swing direction is performed during swing deceleration.

The hydraulic excavator 100 according to a third embodiment of the present invention is explained by using FIG. 9 and FIG. 10.

FIG. 9 is a flowchart illustrating a process of the pump control section 16*b* (illustrated in FIG. 3) according to the present embodiment. Hereinafter, differences from the first embodiment (illustrated in FIG. 4) are explained.

In FIG. 9, when the determination result in Step S6 is No (no swing operation performed), the selector valve 11 is opened in Step S7B, the tilting angle DP of the pump 10 is controlled in Step S8B with the target swing velocity being set to the swing velocity ωact multiplied by a gain smaller than 1 (0.8 in the present embodiment), and the process returns to Step S1. While a swing is being performed and swing operation is not being performed, part (80% in the present embodiment) of the rate of the flow to be taken in by the swing motor 7 from the flow line 50 or 51 (motor flow rate) is thereby supplied from the pump 10.

Subsequent to Step S13, in Step S14B, the tilting angle DP of the pump 10 is controlled with the target swing velocity being set to the swing velocity ωact multiplied by a gain smaller than 1 (0.8 in the present embodiment), and the process returns to Step S1. While reverse lever operation is being performed, part (80% in the present embodiment) of the rate of the flow to be taken in by the swing motor 7 from the flow line 50 or 51 (motor flow rate) is thereby supplied from the pump 10.

FIG. 10 is a figure illustrating operation of the hydraulic closed-circuit system 200 when reverse lever operation is performed in the hydraulic excavator 100 according to the present embodiment. Hereinafter, differences from the first embodiment (illustrated in FIG. 6) are explained.

In FIG. 8, while swing operation is not being performed (Time T2 to Time T3) or reverse lever operation is being performed (Time T3 to Time T4), the selector valve 11 is opened, and part (80% in the present embodiment) of the rate of the flow to be taken in by the swing motor 7 from the flow line 50 or 51 (motor flow rate) is supplied from the pump 10. The deficiency of the flow rate in the closed circuit (flow lines 50 and 51) thereby matches the suction flow rate of the swing motor 7 (motor flow rate) minus the pump flow rate, and becomes lower than the chargeable flow rate QCHmax. Accordingly, the pressure in the closed circuit (flow lines 50 and 51) can be prevented from assuming a negative pressure. At this time, part (80% in the present embodiment) of the discharge flow rate of the swing motor 7 is taken in by the pump 10, and the remaining part (20% in the present embodiment) is discharged to the charge flow line 60 via the relief valve 13*a* or 13*b*. Accordingly, the braking force of the swing motor 7 is maintained.

According to the thus-configured hydraulic excavator 100 according to the present embodiment, while reverse lever operation is being performed, part of the rate of the flow to be taken in by the swing motor 7 from the flow line 50 or 51 is supplied from the pump 10. The deficiency of the flow rate in the closed circuit (flow lines 50 and 51) thereby becomes smaller than that in the second embodiment (illustrated in FIG. 8). Accordingly, the risk of occurrence of cavitation can be kept lower than that in the second embodiment.

Fourth Embodiment

Figure 11:
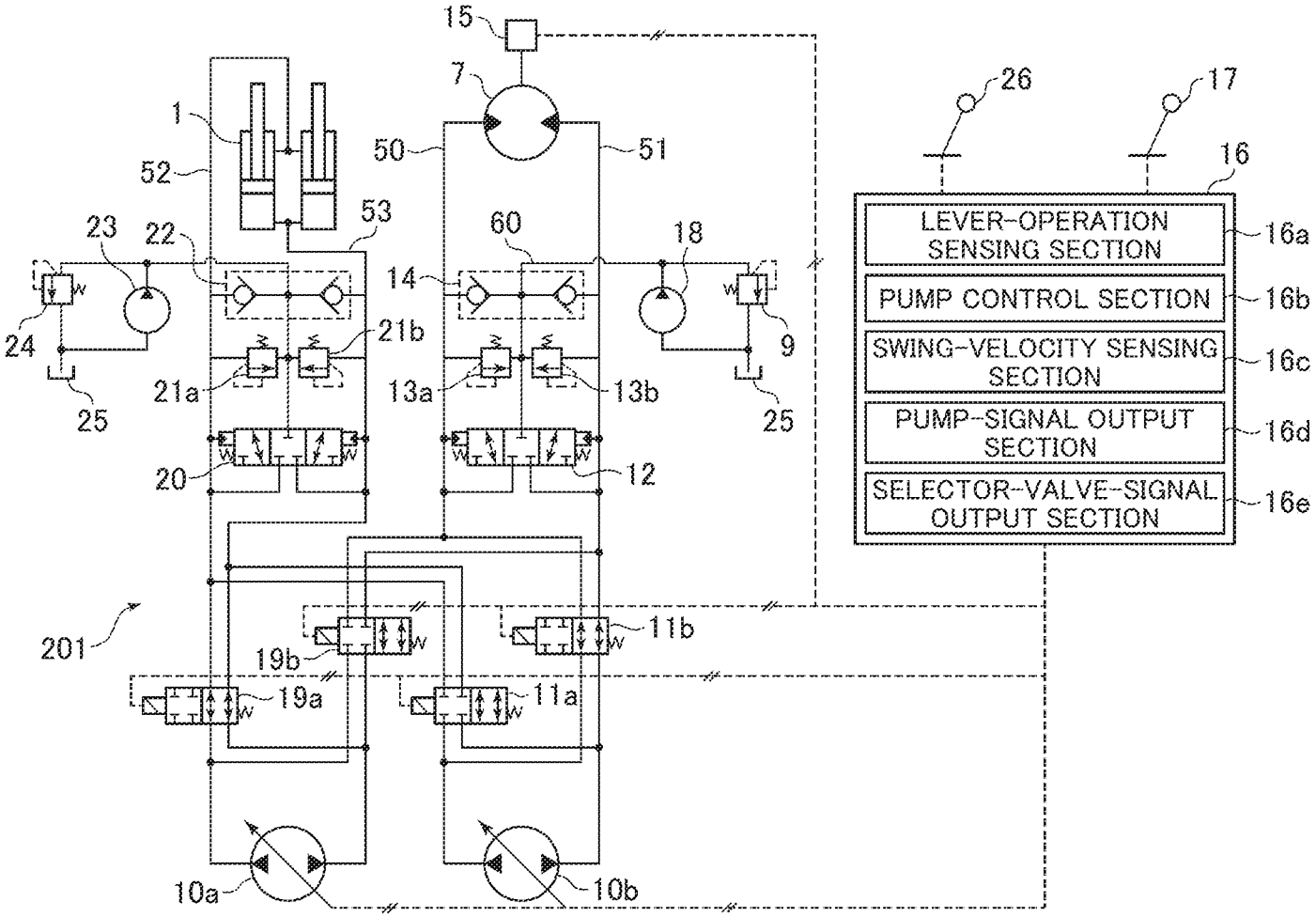
FIG. 11 is a schematic configuration diagram of the hydraulic closed-circuit system mounted on the hydraulic excavator according to a fourth embodiment of the present invention.
Figure 12:
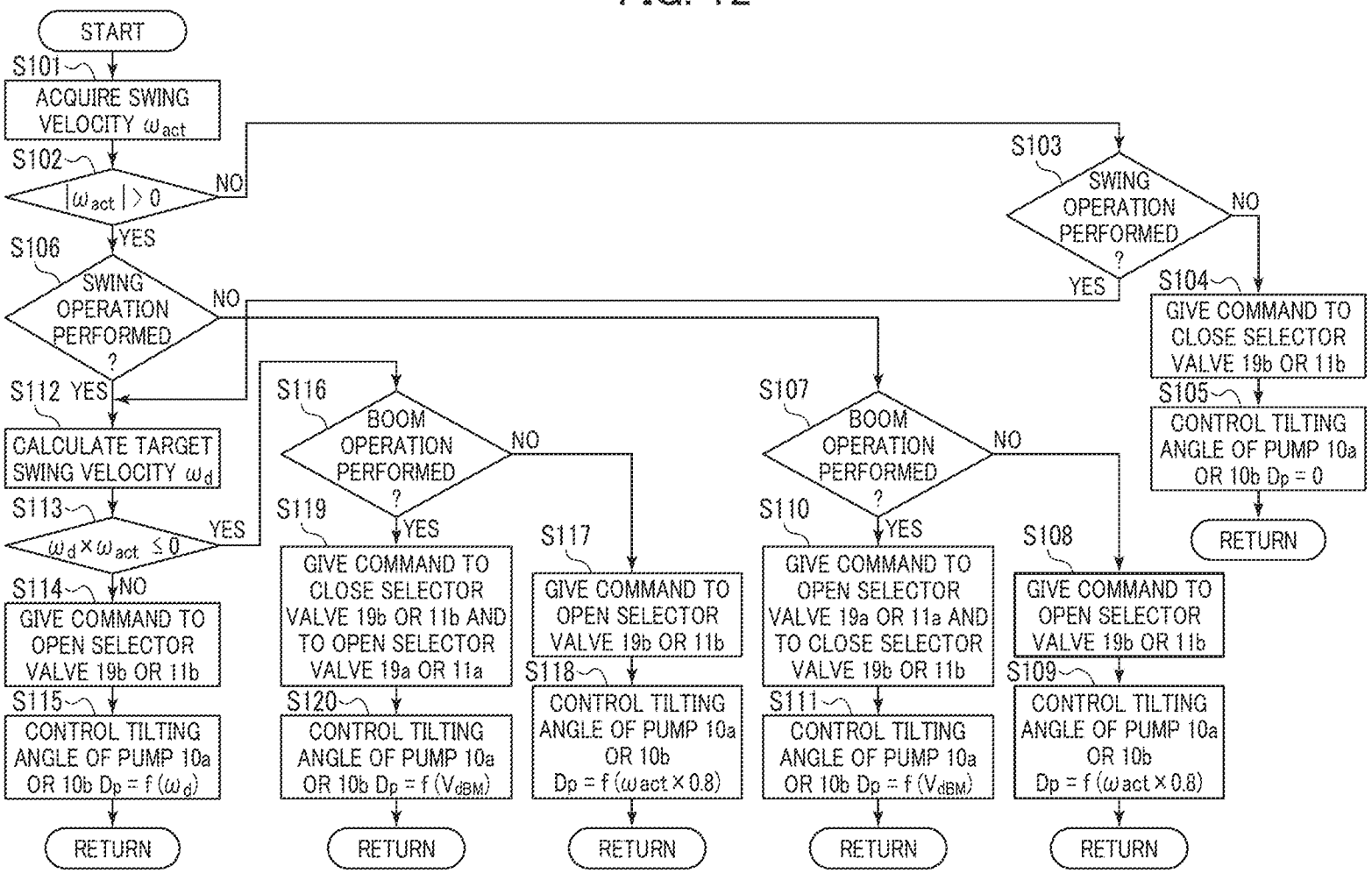
FIG. 12 is a flowchart illustrating a process of the pump control section according to the fourth embodiment of the present invention.
Figure 13:
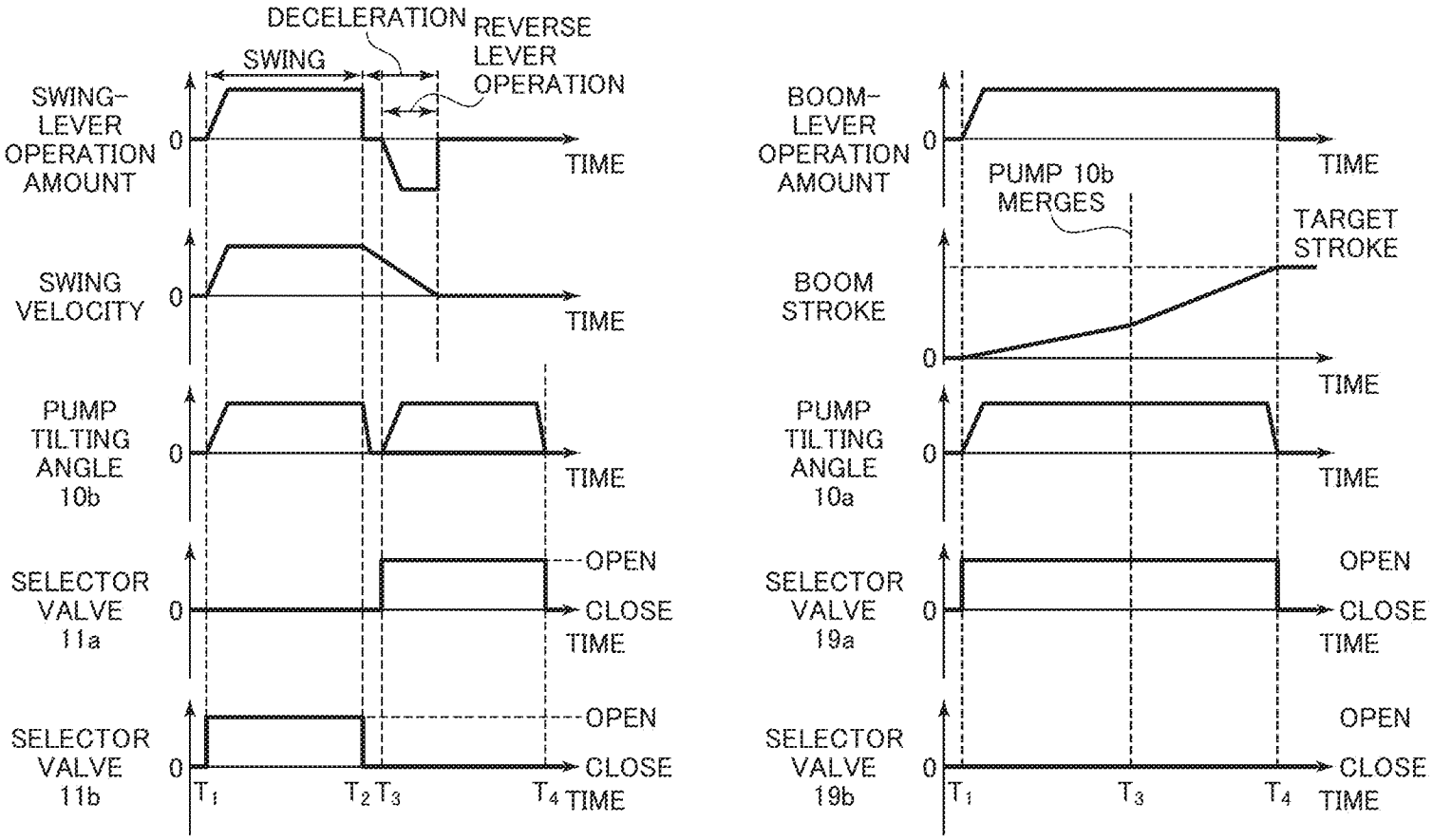
FIG. 13 is a figure illustrating operation in the hydraulic closed-circuit system according to the fourth embodiment of the present invention when reverse lever operation which is an instruction for a swing in a direction opposite to a swing direction is performed during swing deceleration.

The hydraulic excavator 100 according to a fourth embodiment of the present invention is explained by using FIG. 11 to FIG. 13.

FIG. 11 is a schematic configuration diagram of a hydraulic closed-circuit system mounted on the hydraulic excavator 100 according to the present embodiment.

In FIG. 11, a hydraulic closed-circuit system 201 includes bidirectionally tiltable first and second hydraulic pumps (hereinafter, pumps) 10*a* and 10*b* and charge pumps 18 and 23 that are driven by an engine (not illustrated), the swing motor 7, the boom cylinder 1, the swing operation lever 17 for giving an instruction on operation of the upper swing structure 102, the boom-operation lever 26 for giving an instruction on operation of the boom 2 a selector valve 19*a* that establishes or interrupts communication between the pump 10*a* and the boom cylinder 1 via flow lines 52 and 53 to form a closed circuit, a selector valve 11*a* that establishes or interrupts communication between the pump 10*b* and the boom cylinder 1 via the flow lines 52 and 53 to form a closed circuit a selector valve 19*b* that establishes or interrupts communication between the pump 10*a* and the swing motor 7 via the flow lines 50 and 51 to form a closed circuit, a selector valve 11*b* that establishes or interrupts communication between the pump 10*b* and the swing motor 7 via the flow lines 50 and 51 to form a closed circuit, charge relief valves 9 and 24, flushing valves 12 and 20, relief valves 13*a*, 13*b*, 21*a*, and 21*b*, makeup valves 14 and 22, the velocity sensor 15 as a swing-velocity sensor that senses the rotation velocity of the swing motor 7, and the controller 16 as a controller.

The functions of the flushing valve 20, the relief valves 21*a* and 21*b*, the makeup valve 22, the charge pump 23, and the charge relief valve 24 are similar to the functions of the flushing valve 12, the relief valves 13*a* and 13*b*, the makeup valve 14, the charge pump 18, and the charge relief valve 9 explained in the first embodiment. Accordingly, explanations thereof are omitted.

The controller 16 controls the pumps 10*a* and 10*b* and the selector valves 11*a*, 11*b*, 19*a*, and 19*b* on the basis of operation amounts of the swing operation lever 17 and the boom-operation lever 26 and information from various types of sensors including the velocity sensor 15.

When the boom cylinder 1 is driven by the pumps 10*a* and 10*b*, the selector valves 19*a* and 11*a* are opened and the selector valves 19*b* and 11*b* are closed. A closed-circuit connection is thereby established between each of the pumps 10*a* and 10*b* and the boom cylinder 1, and the tilting angles of the pumps 10*a* and 10*b* are controlled according to the operation amount of the boom-operation lever 26.

When the swing motor 7 is driven by the pumps 10*a* and 10*b*, the selector valves 19*b* and 11*b* are opened and the selector valves 19*a* and 11*a* are closed. A closed-circuit connection is thereby established between each of the pumps 10*a* and 10*b* and the swing motor 7, and the tilting angles of the pumps 10*a* and 10*b* are controlled according to the operation amount of the swing operation lever 17.

When the boom cylinder 1 is driven by the pump 10*a* and the swing motor 7 is driven by the pump 10*b*, the selector valves 19*a* and 11*b* are opened and the selector valves 19*b* and 11*a* are closed. As a result, closed-circuit connection is established between the pump 10*a* and the boom cylinder 1, a closed-circuit connection is established between the pump 10*b* and the swing motor 7, the tilting angle of the pump 10*a* is controlled according to the operation amount of the boom-operation lever 26, and the tilting angle of the pump 10*b* is controlled according to the operation amount of the swing operation lever 17.

FIG. 12 is a flowchart illustrating a process of the pump control section 16*b* according to the present embodiment. Hereinafter, steps are explained one by one.

Steps S101 to S103 and S106 are similar to Steps S1 to S3 and S6 in the first embodiment (illustrated in FIG. 4). Accordingly, explanations thereof are omitted.

When the determination result in Step S103 is No (no swing operation performed), the selector valves 19*b* and 11*b* are closed in Step S104, the tilting angle DP of the pumps 10*a* and 10*b* are controlled such that the tilting angle DP becomes 0 in Step S105, and the process returns to Step S101. A hydraulic operating fluid is thereby not supplied from the pumps 10*a* and 10*b* to the swing motor 7, and the swing motor 7 is kept stopped.

When the determination result in Step S106 is No (no swing operation performed), in Step S107, it is determined whether or not boom operation is performed.

When the determination result in Step S107 is No (no boom operation performed), the selector valve 19*b* or 11*b* is opened in Step S108, the tilting angle DP of the pump 10*a* or 10*b* is controlled at Step S109 with the target swing velocity being set to the swing velocity ωact multiplied by a gain smaller than 1 (0.8 in the present embodiment), and the process returns to Step S101. While a swing is being performed singly and swing operation is not being performed, part (80% in the present embodiment) of the rate of the flow to be taken in by the swing motor 7 from the flow line 50 or 51 is thereby supplied from the pump 10*a* or 10*b*.

When the determination result in Step S107 is Yes (boom operation performed), the selector valve 19*a* or 11*a* is opened and the selector valves 19*b* and 11*b* are closed in Step S110, the tilting angle DP of the pump 10*a* or 10*b* is controlled according to the target boom velocity VdBM in Step S111, and the process returns to Step S101. The hydraulic operating fluid is thereby supplied from the pump 10*a* or 10*b* to the boom cylinder 1, and the boom cylinder 1 is driven.

When the determination result in Step S106 is Yes (swing operation performed) or if the determination result in Step S103 is Yes (swing operation performed), Steps S112 and S113 are executed. Steps S112 and S113 are similar to Steps S9 and S10 in the first embodiment (illustrated in FIG. 4). Accordingly, explanations thereof are omitted.

When the determination result in Step S113 is No (forward lever operation performed), the selector valve 19*b* or 11*b* is opened in Step S114, the tilting angle DP of the pump 10*a* or 10*b* is controlled according to the target swing velocity ωd in Step S115, and the process returns to Step S101. The hydraulic operating fluid is thereby supplied from the pump 10*a* or 10*b* to the swing motor 7, and the swing motor 7 is driven.

When the determination result in Step S113 is Yes (reverse lever operation performed), in Step S116, it is determined whether or not boom operation is performed.

When the determination result in Step S116 is No (no boom operation performed), reverse lever operation is being performed while a swing is being performed singly. Accordingly, the selector valve 19*b* or 11*b* is opened in Step S117, the tilting angle of the pump 10*a* or 10*b* is controlled in Step S118 with the target swing velocity being set to the swing velocity ωact multiplied by a gain smaller than 1 (0.8 in the present embodiment), and the process returns to Step S101. While a swing is being performed singly and reverse lever operation is being performed, part (80% in the present embodiment) of the rate of the flow to be taken in by the swing motor 7 from the flow line 50 or 51 is thereby supplied from the pump 10*a* or 10*b*.

When the determination result in Step S116 is Yes (boom operation performed), the selector valves 19*b* and 11*b* are closed and the selector valve 19*a* or 11*a* is opened according to the target boom velocity VdBM in Step S119, the tilting angles DP of the pumps 10*a* and 10*b* are controlled according to the target boom velocity VdBM at Step S120, and the process returns to Step S101. When reverse lever operation is performed during boom operation, according to the target boom velocity VdBM, the hydraulic operating fluid is supplied to the boom cylinder 1 from the pump 10*a* or 10*b* which has been used for driving of the swing motor 7.

FIG. 13 is a figure illustrating operation of the hydraulic closed-circuit system 200 when reverse lever operation is performed in the hydraulic excavator 100 according to the present embodiment. In the case explained in the present embodiment, reverse lever operation is performed during combined operation of a swing and boom raising.

At Time T1, operation of the swing operation lever 17 and the boom-operation lever 26 is started. Accordingly, the tilting angles of the pumps 10*a* and 10*b* are controlled according to the target velocity of each of the actuators 1 and 7, the selector valve 19*a* connecting the pump 10*a* and the boom cylinder 1 is opened, and the selector valve 11*b* connecting the pump 10*b* and the swing motor 7 is opened. As a result, the boom cylinder 1 is driven according to the rate of the flow from the pump 10*a*, and the swing motor 7 is driven according to the rate of the flow from the pump 10*b*.

When the operation amount of the swing operation lever 17 becomes 0 at Time T2, the tilting angle of the pump 10*b* becomes 0, and the selector valve 11*b* is closed. The supply of the hydraulic operating fluid from the pump 10*b* to the swing motor 7 is thereby stopped. Accordingly, deceleration of the swing motor 7 is started.

When the reverse lever operation is started at Time T3, the selector valve 11*b* is closed and the selector valve 11*a* is opened. The pump 10*b* having been connected to the swing motor 7 is thereby connected to the boom cylinder 1, and the tilting angle of the pump 10*b* is controlled according to the target boom velocity VdBM. The boom cylinder 1 is thereby supplied with the hydraulic operating fluid from the two pumps 10*a* and 10*b* and gains velocity, and a target stroke can be reached at Time T4.

According to the thus-configured hydraulic excavator 100 according to the present embodiment, when reverse lever operation is performed while a swing is being performed singly, part of the rate of the flow to be taken in by the swing motor 7 from the flow line 50 or 51 is supplied from the pump 10*a* or 10*b*. Accordingly, the risk of occurrence of cavitation can be kept low, similarly to the third embodiment.

On the other hand, when reverse lever operation is performed during combined operation of operation of the boom and a swing, the pump 10*b* having been connected to the swing motor 7 is connected to the boom cylinder 1. The rate of the flow to be taken in by the pump 10*a* or 10*b* from the flow line 50 or 51 on the suction-side of the swing motor 7 thereby becomes 0. Accordingly, the risk of occurrence of cavitation can be kept low, similarly to the second embodiment. In addition, during reverse lever operation, the hydraulic operating fluid can be supplied to the boom cylinder 1 from the pump 10*a* or 10*b* having been used for driving of the swing motor 7. Accordingly, the work efficiency of the hydraulic excavator 100 in which combined operation of a swing and boom raising is particularly performed often can be improved.

Note that, although, in the aspects explained in the embodiments of the present invention, the hydraulic pump having been connected to the swing motor is connected to the boom cylinder in a case that reverse lever operation is performed during combined operation of operation of the boom and a swing, the section to which the hydraulic pump is connected may be a hydraulic cylinder other than the boom cylinder, and the hydraulic pump having been connected to the swing motor may be connected to a cylinder to drive an actuator other than the boom such as the arm or the bucket during combined operation of a swing and operation of the actuator other than the boom mentioned above.

While embodiments of the present invention are explained in detail thus far, the present invention is not limited to the embodiments explained above and includes various modifications. For example, the embodiments explained above are explained in detail in order to explain the present invention in an easy-to-understand manner, and are not necessarily limited to ones including all the configurations explained. Furthermore, it is also possible to add some of the configurations of an embodiment to the configurations of another embodiment, and it is also possible to eliminate some of the configurations of an embodiment or to replace some of the configurations of an embodiment with part of another embodiment.

DESCRIPTION OF REFERENCE CHARACTERS

1: Boom cylinder
2: Boom
3: Arm cylinder
4: Arm
5: Bucket cylinder
6: Bucket
7: Swing motor
8: Travel device
9: Charge relief valve
10, 10*a*: Hydraulic pump (first hydraulic pump)
10*b*: Hydraulic pump (second hydraulic pump)
11, 11*a*, 11*b*: Selector valve
12: Flushing valve
13*a*, 13*b*: Relief valve
14: Makeup valve
15: Velocity sensor
16: Controller
16*a*: Lever-operation sensing section
16*b*: Pump control section
16*c*: Swing-velocity sensing section
16*d*: Pump-signal output section
16*e*: Selector-valve-signal output section
17: Swing operation lever
18: Charge pump
19*a*, 19*a*: Selector valve
20: Flushing valve
21*a*, 21*b*: Relief valve
21*b*: Relief valve
22: Makeup valve
23: Charge pump
24: Charge relief valve
25: Hydraulic operating fluid tank
26: Boom-operation lever
50 to 53: Flow line
60: Charge flow line
100: Hydraulic excavator
101: Cab
102: Upper swing structure
103: Lower track structure
104: Front work implement
200, 201: Hydraulic closed-circuit system

The invention claimed is:

1. A work machine comprising:
a lower track structure;
an upper swing structure swingably attached onto the lower track structure;
a swing motor that drives the upper swing structure;
a bidirectionally tiltable first hydraulic pump;
two flow lines that connect the swing motor and the first hydraulic pump to form a closed circuit;
a charge pump;
a charge flow line connected to the charge pump;
a supplementing valve device that is provided between the two flow lines and the charge flow line and supplements a deficiency of a flow rate in the two flow lines with a flow from the charge flow line;
a swing operation lever for giving an instruction on operation of the upper swing structure;
a swing-velocity sensor that senses a swing velocity of the upper swing structure; and
a controller that controls a tilting angle of the first hydraulic pump according to operation of the swing operation lever, wherein
the controller is configured to perform control such that a rate of a flow supplied from the first hydraulic pump to the swing motor becomes lower than a pump flow rate according to an operation amount of the swing operation lever when a swing direction corresponding to a swing velocity sensed at the swing-velocity sensor is different from a swing direction corresponding to operation of the swing operation lever.

2. The work machine according to claim 1, wherein
the supplementing valve device is a makeup valve or a flushing valve.

3. The work machine according to claim 1, comprising:

a boom attached to a front side of the upper swing structure such that the boom pivots upward and downward;

a boom cylinder that drives the boom;

a bidirectionally tiltable second hydraulic pump;

a plurality of selector valves that establish a closed-circuit connection between each of the first and second hydraulic pumps and the swing motor or the boom cylinder; and a boom-operation lever for giving an instruction on operation of the boom, wherein the controller is configured to control the plurality of selector valves such that the first hydraulic pump is connected to the boom cylinder and control a tilting angle of the first hydraulic pump according to the operation of the boom-operation lever when the swing direction corresponding to the swing velocity sensed at the swing-velocity sensor is different from the swing direction corresponding to the operation of the swing operation lever and the boom-operation lever is operated.

4. The work machine according to claim 1, comprising:

a front work implement as a work device having a base end section attached to the upper swing structure;

a selector valve that establishes a closed-circuit connection between the first hydraulic pump and a hydraulic cylinder that drives the front work implement; and an operation lever for operating the front work implement, wherein the controller is configured to control the selector valve such that the first hydraulic pump is connected to the hydraulic cylinder that drives the front work implement when the swing direction corresponding to the swing velocity sensed at the swing-velocity sensor is different from the swing direction corresponding to the operation of the swing operation lever and the operation lever is operated.

* * * * *